US006889978B2

(12) United States Patent
Schaefer et al.

(10) Patent No.: US 6,889,978 B2
(45) Date of Patent: May 10, 2005

(54) LOTTERY TICKET WITH PLAY ACTION GAME

(75) Inventors: Carla Schaefer, San Antonio, TX (US); Noreen Huante Fowler, San Antonio, TX (US)

(73) Assignee: Oberthur Gaming Technologies, Inc., Montreal (CA)

( * ) Notice: Subject to any disclaimer, the term of this patent is extended or adjusted under 35 U.S.C. 154(b) by 159 days.

(21) Appl. No.: 09/887,422

(22) Filed: Jun. 22, 2001

(65) Prior Publication Data

US 2002/0003335 A1 Jan. 10, 2002

Related U.S. Application Data

(60) Provisional application No. 60/215,852, filed on Jul. 3, 2000.

(51) Int. Cl.[7] ..... A63F 3/00

(52) U.S. Cl. ..... 273/139; 463/17

(58) Field of Search ..... 273/240, 269, 273/272, 139; 463/17; 283/901, 902, 903

(56) References Cited

U.S. PATENT DOCUMENTS

| | | | | |
|---|---|---|---|---|
| 3,826,499 A | * | 7/1974 | Lenkoff | 273/139 |
| 4,491,319 A | | 1/1985 | Nelson | |
| 5,411,260 A | | 5/1995 | Smith | |
| 5,560,608 A | | 10/1996 | Silverschotz | |
| 5,657,991 A | | 8/1997 | Camarato | |
| 6,241,246 B1 | * | 6/2001 | Guttin et al. | 273/138.1 |

* cited by examiner

*Primary Examiner*—Vishu K Mendiratta
(74) *Attorney, Agent, or Firm*—Watov & Kipnes, P.C.

(57) ABSTRACT

A lottery ticket including a play action game in which symbols from a first game area are matched with symbols from a second and third game area. Matching all of the symbols in the second game area before the third game area may result in the winning of a prize.

12 Claims, 4 Drawing Sheets

LOTTERY TICKET WITH PLAY ACTION GAME

This application claims the benefit of provisional application Ser. No. 60/215,852, filed Jul. 3, 2000.

FIELD OF THE INVENTION

The present invention is directed to a lottery ticket which provides the exposure of target symbols from a first game area. The target symbols include key symbols and non-key symbols. Some or all of the key symbols from the first game area find correspondence in a second game area. One object of the game is to complete the second game area with key symbols obtained from the first game area before a predetermined number of non-key symbols are located. Another object may be to complete at least a minimum number of groups of key symbols before the predetermined number of non-key symbols are located. The non-key symbols may be accounted for in a third game area so that the player may visually compare the number of key symbols needed to win a prize against the number of non-key symbols which will result in no prize being awarded.

BACKGROUND OF THE INVENTION

Scratch-off lottery tickets are common in the lottery industry. Game data is covered by a scratch-off layer and when the scratch-off layer is removed the game data is exposed. In typical scratch-off lottery tickets a grid of game symbols is covered by a scratch-off layer. Once the scratch-off layer is removed, if the game symbols provide a certain pattern (e.g. three of the same symbol) the player may win a prize. Thus, the typical scratch-off lottery tickets require the player to remove the scratch-off layer and immediately determine if a prize has been won.

It is desirable in the scratch-off lottery industry to provide lottery tickets which not only provide the opportunity to win a prize, but also provide the opportunity to play a game which adds to the value and enjoyment of the lottery ticket itself. It would therefore be a significant advance in the scratch-off lottery ticket industry to provide a lottery game which can provide the opportunity to play a game in which the winning of a prize may be dependent on completing a set of symbols present in one game area before completing a set of symbols present in another game area.

SUMMARY OF THE INVENTION

The present invention is generally directed to a lottery ticket employing a game in which the player is provided with a target group of symbols which contain both key symbols and non-key symbols. The target symbols are hidden by a scratch-off layer and appear in a first game area. The player exposes individual target symbols from the first game area by removing the scratch-off layer which overlays the target symbols. If an exposed target symbol is a key symbol, the player makes a notation in a second game area containing only key symbols. If the target symbol exposed is a non-key symbol, the player must remove the scratch-off layer from one of the designated play areas of the third game area which may contain a non-key symbol or corresponding designation thereof. If the player completes the second game area containing all of the key symbols before all play areas in the third game area are exposed, then a prize may be won.

In a particular aspect of the present invention, there is provided a lottery ticket comprising a substrate having thereon:

a) a first game area comprised of a plurality of target symbols comprising key symbols and non-key symbols, said target symbols being covered by a scratch-off layer;

b) a second game area comprised of at least one group of said key symbols; and c) a third game area comprised of a preselected number of play areas, each containing a second non-key symbol which may be the same of different than the first non-key symbol, wherein the player exposes the target symbols from the first game area by removing the scratch-off layer and if the exposed target symbols provide all of the key symbols necessary to either complete the second game area or to complete at least a minimum number of groups of key symbols, but not a number of first non-key symbols corresponding to the preselected number of play areas in the third game area then a prize may be won.

BRIEF DESCRIPTION OF THE DRAWINGS

The following drawings in which like reference characters indicate like parts are illustrative of embodiments of the invention and are not intended to limit the invention as disclosed in the application.

DETAILED DESCRIPTION OF THE INVENTION

The present invention is directed to a lottery ticket in which a first game area has a plurality of target symbols such as letters in which some of the target symbols will find correspondence in a second game area. A third game area is provided which contains a preselected number of play areas which are played each time a non-key symbol is exposed in the first game area. If the player completes the second game area or a designated portion of the second game area with key symbols before having to play all of the play areas of the third game area, then a prize may be won.

Figure 1:
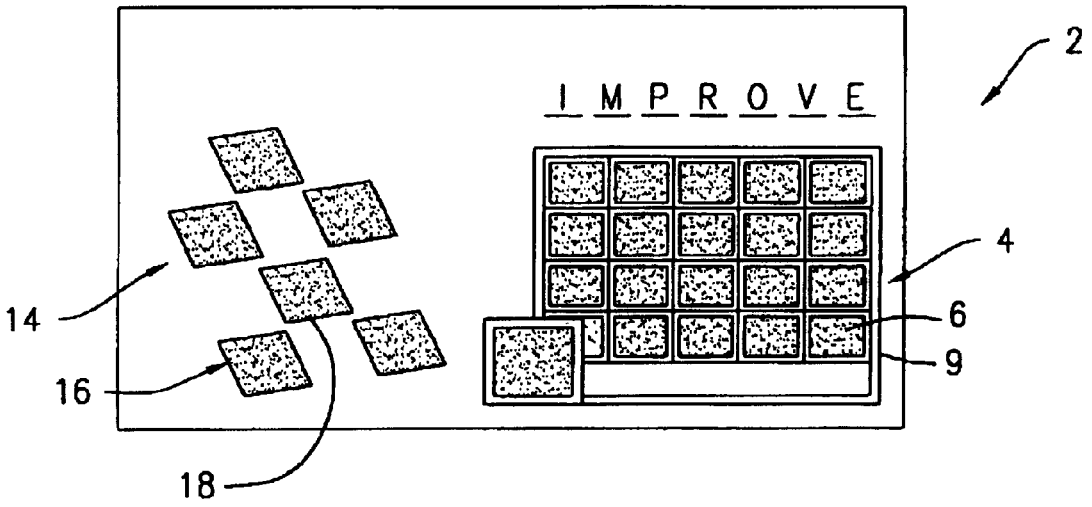
FIG. 1 is a top view of an embodiment of the lottery ticket of the present invention.

An embodiment of the present invention is shown in FIG. 1. Referring to FIG. 1 there is shown the face of a lottery ticket 2 which may be constructed as conventional lottery tickets, typically on paperboard with layers of ink, protective coatings and the like. The present invention provides for a play action making use of symbols which appear in a first game area. The first game area 4 includes a plurality of spaces 6 each of which has a target symbol 8 (see FIG. 2) covered by a scratch-off layer 9. The target symbols contained in the first game area 4 include key symbols identified by the numeral 10*a* and non-key symbols identified by the numeral 10*b*. The term "key symbols" as used herein includes any symbol which finds correspondence in a second game area or designated portion thereof. Such symbols may include, for example, letters, numbers, designs, pictures, objects and the like. The term "non-key symbols" includes any symbol which does not find correspondence in the second game area. Such symbols may include, for example, letters, numbers, designs, pictures, objects and the like. In addition, a non-key symbol may also include a blank space (i.e. when the scratch-off layer is removed from a space 6, the space appears as a blank in that it does not contain a symbol of the type described above).

The key symbols 10*a* identified in the second game area 12 may find correspondence in the first game area 4 but not in a third game area 14 as explained hereinafter. The object of the play action therefore is to locate all of the key symbols in the first game area which find correspondence in the second game before all of the play areas in the third game area are exposed.

The key symbols 10*a* (see FIG. 2) may be the same or different from each other. An essential feature of the key symbol 10*a* is that it must be different from the non-key symbol 10*b* so that the key symbols may be differentiated from the non-key symbols. As shown specifically in FIGS. 1–4, the key symbols 10*a* comprise individual letters which make up the single word "IMPROVE" as appears in the second game area 12. The object of the play action game in this embodiment of the invention is to uncover in the first game area 4 all of the key symbols 10*a* which appear in the second game area 12 before a number of non-key symbols 10*b* corresponding to the number of play areas 16 in the third game area 14 are exposed as explained hereinafter.

As shown in FIG. 1, the second game area 12 is comprised of a plurality of key symbols 10*a*. In a preferred form of the invention the key symbols are arranged in the second game area 12 to form a single word, multiple words or some other single or multiple identifiable patterns (e.g. a number pattern such as 1, 2, 3, etc.). The third game area 14 contains a preselected number of play areas 16. The play areas 16 are each covered with a scratch-off layer. The removal of the scratch-off layer from each play area 16 is an indication that the player has exposed a non-key symbol 10*b* in the first game area 4. If all of the play areas 16 are exposed by removing the respective scratch-off layers before the second game area 12 is completed or designated portion thereof, the player may not win a prize.

Figure 2:
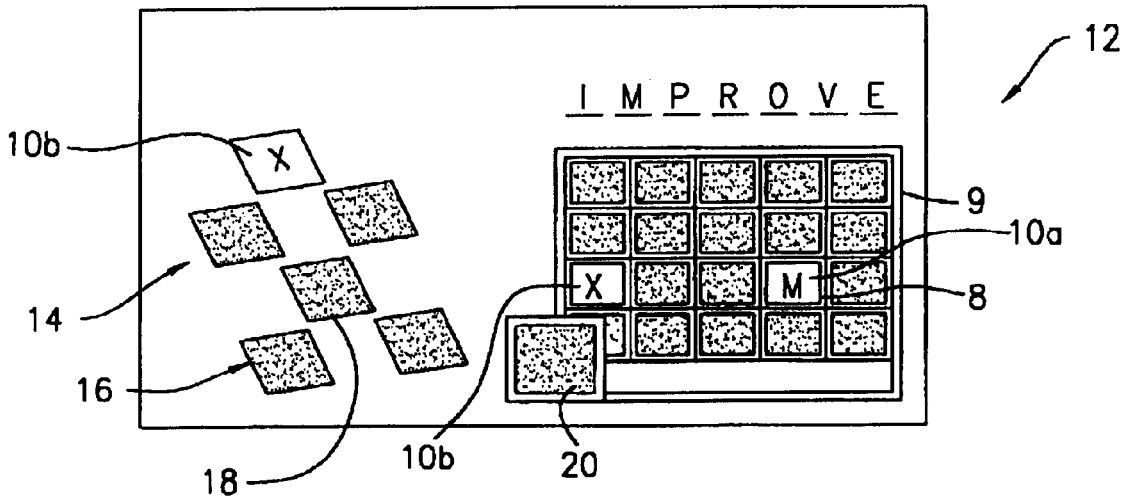
FIGS. 2–4 are top views of the lottery ticket shown in FIG. 1 at various stages of the play action of the lottery ticket game.
Figure 3:
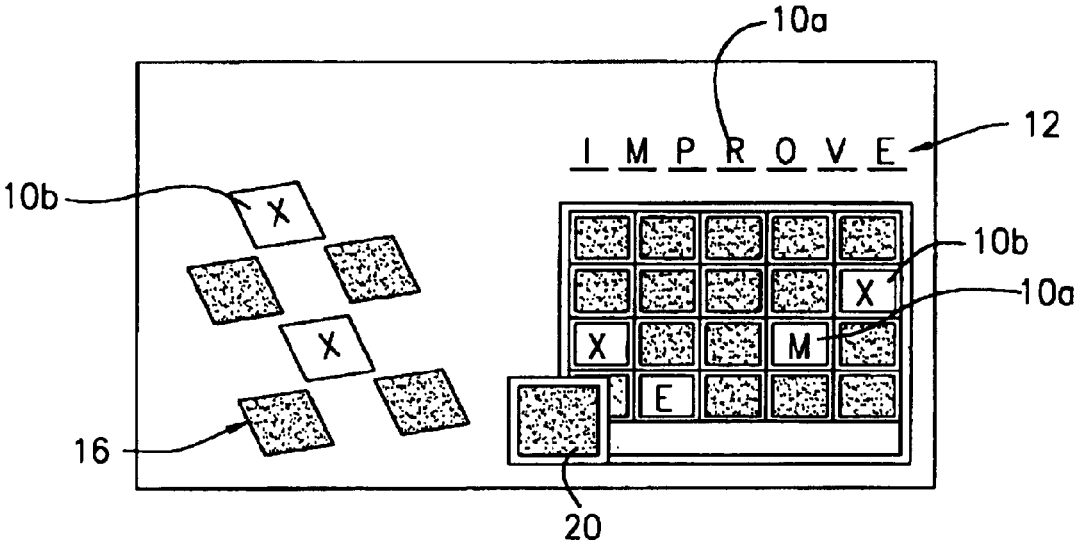
Figure 4:
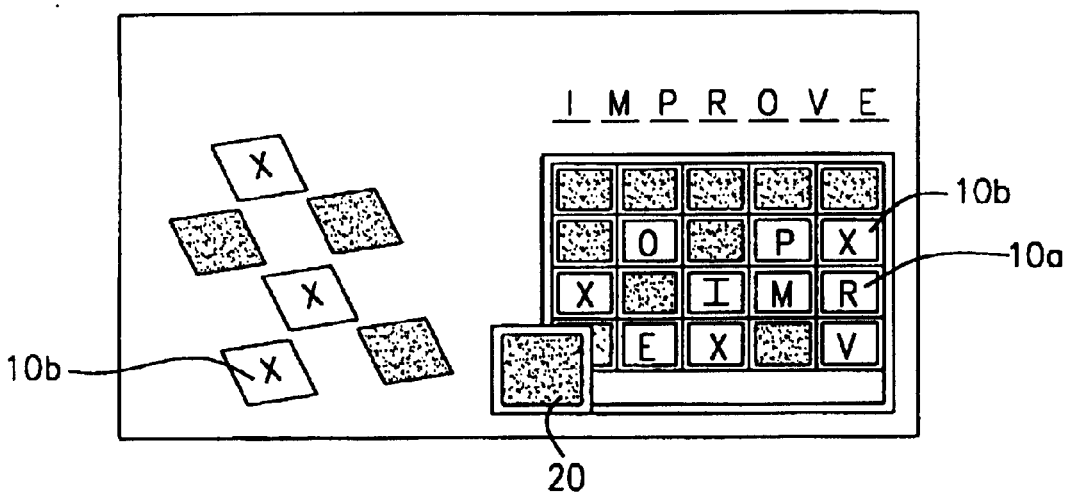

In one embodiment of the invention and as specifically shown in FIG. 1, each play area 16 has beneath a scratch-off layer 18 a non-key symbol 10*b*. The non-key symbols 10*b* may be the same or different from each other but must be different than the key symbols 10*a*. As shown in FIGS. 2–4, all of the non-key symbols 10*b* are the same (i.e. the letter "X"). The non-key symbol 10*b* may also be blank spaces which, after removal of the scratch-off layer 18, may be differentiated from the play areas 16 which are still covered by the scratch-off layer 18.

As shown specifically in FIG. 2, the player removes the scratch-off layer 9 from an individual space 6 in the first game area 4 to reveal a target symbol 8 which may be a key symbol 10*a* or a non-key symbol 10*b*. As shown specifically in FIG. 2, the key symbol 10*a* is in the form of the letter "M". The letter M also appears in the second game area 12 and therefore is a key symbol. The player now has one of the seven key symbols 10*a* needed to spell the single word IMPROVE which appears in the second game area 12. The player then moves to a second space 6 and removes the scratch-off layer 9 to reveal another target symbol 8 which may be a key symbol 10*a* or a non-key symbol 10*b*. As shown specifically in FIG. 2, exposing the second space 6 reveals a non-key symbol 10*b* in the form of the letter "X". The letter "X" is a non-key symbol 10*b* because it does not find correspondence among the symbols comprising the second game area 12. Therefore the player must remove the scratch-off layer 18 from one of the play areas 16 in the third game area 14.

The player continues to play the game in the same manner by exposing additional target symbols 8 beneath the scratch-off layer 9 of the individual spaces 6 in the first game area 4. As shown, for example, in FIG. 3, the key symbol 10*a* in the form of the letter "E" is exposed followed by the non-key symbol 10*b* in the form of the letter "X". As a result, the player now has two of the key symbols 10*a* (E and M) needed to complete the second game area 12 and thereby spell the word IMPROVE. However, the player also has exposed another non-key symbol ("X") and therefore is required to remove scratch-off layer 18 from another play area 16 in the third game area 14.

The player continues until all of the spaces in the first game area 14 have been exposed, and all of the key symbols 10*a* in the second game area 12 have been matched or all of the play areas 16 in the third game area 14 have been exposed. If all of the key symbols 10*a* in the second game area 12 have been matched before the play areas 16 in the third game area 14 have been exposed to reveal non-key symbols 10*b*, then a prize may be won.

In this regard, reference is made to FIG. 4 in which additional target symbols 8 in the first game area 4 have been exposed. As shown specifically in FIG. 4, the target symbols 8 which have been exposed show that all of the key symbols 10*a* in the first game area 4 (spelling the word IMPROVE) have been matched before all of the play areas 16 (and therefore the non-key symbols) in the third game area 14 have been exposed. In this case, the player may be entitled to a prize. Conversely, if all of the play areas 16 in the third game area 14 were exposed in accordance with the rules of the play action, before completion of the spelling of the word IMPROVE in the second game area 12, the player would not be entitled to a prize.

The lottery ticket may also include a prize determining area 20 which includes a prize amount which may be covered by a scratch-off layer. If the ticket is a winning ticket as specifically shown in FIG. 4, the player may simply scratch-off the prize determining area 20 to reveal the amount of the prize that he or she may have won.

It will be understood that the embodiment of the lottery ticket shown in FIGS. 1–4 is exemplary of the type of lottery ticket covered by the present application. Variations may be made which would be apparent to those of ordinary skill in the art. For example, the second game area 12 may contain the key symbols 10*a* which are different from each other as shown in FIGS. 1–4 or the same key symbol (e.g. all "W"s). What is required is that key symbols 10*a* present in the second game area 12 are different than the non-key symbols 10*b* present in the third game area 14. In addition, the play areas 16 comprising the third game area 14 may be arranged in any design and printing graphics may be used to form a design in connection with the play areas 16. For example, the play areas may be arranged in a circle and the printing graphics may be in the form of a Ferris wheel. By way of a further example, the play areas may be arranged in the form of a triangle and the printing graphics may be designed to simulate a pyramid. By way of an additional example, the play areas may be arranged in the form of a human body with the printing graphics further detailing the shape of the human body.

As shown specifically in FIGS. 1–4, the second game area 12 contains letters which spell a word. The second game area need not have letters but may instead use numbers or other key symbols which find correspondence among the target symbols 8 present in the first game area 4.

The play action game of the present invention may be played as a game of chance or as a probability game where the player has some input in determining whether a prize has been won. For a game of chance, the number of target symbols in the first game area 4 could equal the number of key symbols 10*a* appearing in the second game area 12 and non-key symbols 10*b* appearing in the third game area 14. In this arrangement, the player has no affect on the outcome of the game since winning or losing of the game is predetermined.

Alternatively, the play action game may be played as a probability game in which the total number of target symbols exceed the number of key symbols 10*a* and/or non-key symbols 10*b* needed to complete the game. Thus, the winning of a prize is in part determined by which spaces 6 are exposed by the player and the order in which they are exposed.

In accordance with a further aspect of the present invention, there may be employed printing systems which enable the player to more clearly know which spaces and/or play areas have been exposed during the play action game. One such system is a dual transparent layer system which employs at least one clear, transparent scratch-off layer and at least one colored, transparent layer thereover which is made from a non-scratch-off material. The non-scratch-off layer is joined to the scratch-off layer (e.g. by imprinting directly thereon) such that removal of the transparent scratch-off layer also removes the transparent non-scratch-off layer as disclosed in Holman et al. U.S. Pat. No. 6,076,860 incorporated herein by reference. Other such systems are disclosed in Desbiens, U.S. Reissue Pat. No. 34,673 and Paris, U.S. Pat. No. 5,386,985 each of which is incorporated herein by reference.

The employment of the dual transparent layer system enables the use of a plurality of transparent inks which can be used to print a wide variety of designs including the multicolor printing techniques disclosed in U.S. Pat. No. 5,704,647 incorporated herein by reference. In addition, the dual transparent layer system can be used, for example, in the second and/or third game areas to "mark" a space from which the scratch-off layer has been removed.

Figure 5:
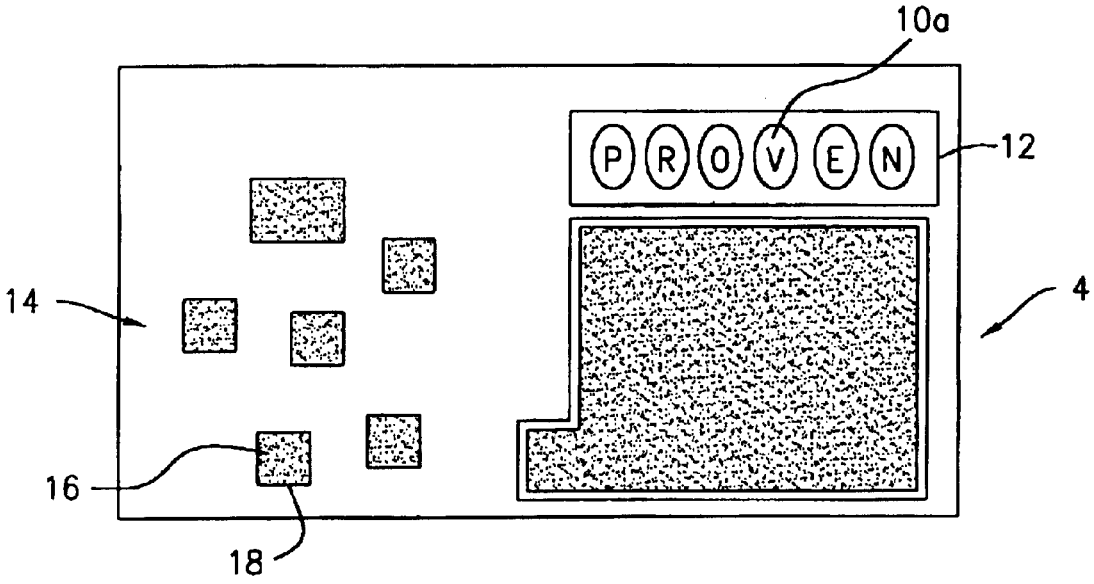
FIGS. 5 and 6 are top views of another embodiment of a lottery ticket in accordance with the present invention.
Figure 6:
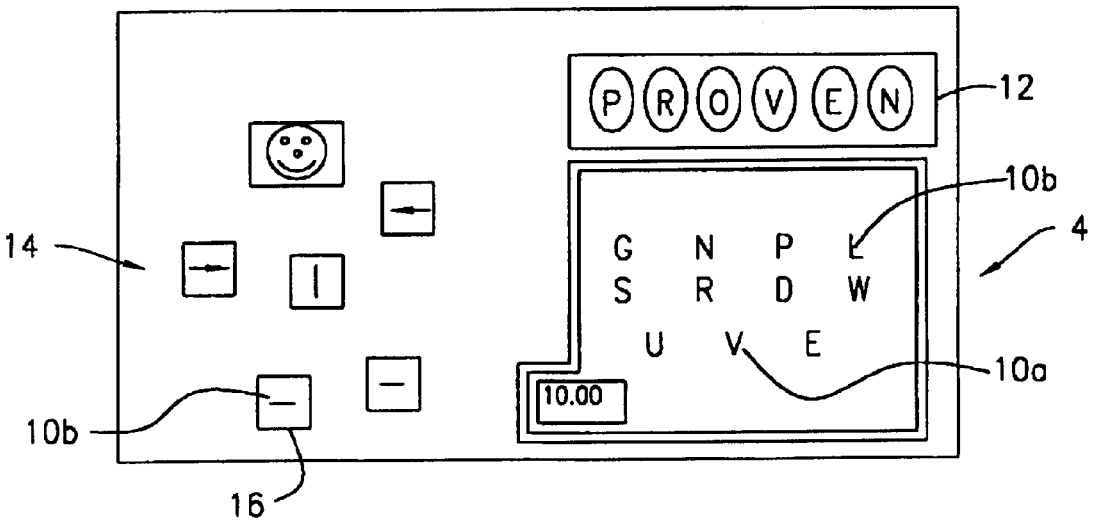

In a further embodiment of the invention as shown in FIGS. 5 and 6, the play areas 16, after removal of the scratch off layer 18, reveal non-key symbols 10*c* which are different than the non-key symbols 10*b* appearing in the first game area 4. More specifically, the embodiment shown in FIGS. 5 and 6 employs a first game area 4 having key symbols 10*a* which are letters that spell the word "PROVEN" shown in the second game area 12. The first game area 4 also contains non-key symbols 10*b* which comprise letters (i.e. G, L, S, W and U) which do not appear in the second game area 12. When a player reveals a non-key symbol 10*b* (e.g. the letter "L") in the first game area 4, he or she is required to remove the scratch-off layer 18 from one of the play areas 16 in the third game area 14 as in the embodiments shown in FIGS. 1–4. However, in the embodiment of FIGS. 5 and 6, each play area 16 contains a non-key symbol 10*c* which is different than the non-key symbol 10*b*. The non-key symbols 10*c* can include any symbols (except key symbols 10*a*) to facilitate elaborate designs for the third game area 14 in which the non-key symbols 10*c* become part of the overall design (e.g. the individual cars of a Ferris wheel).

Figure 7:
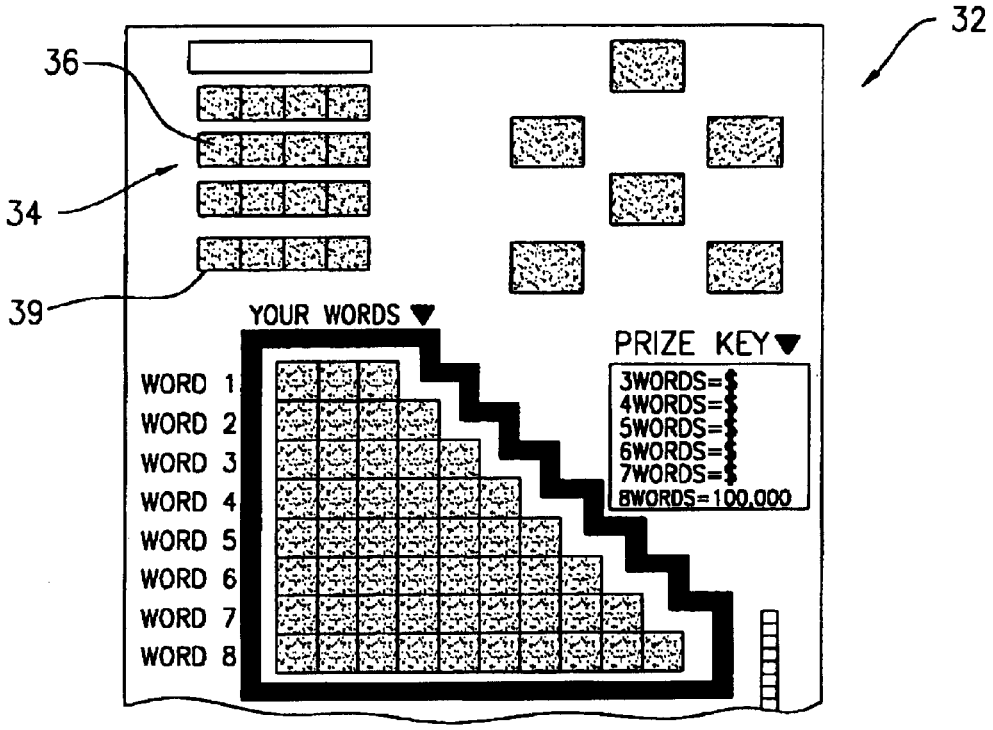
FIGS. 7 and 8 are top views of still another embodiment of a lottery ticket in accordance with the present invention.
Figure 8:
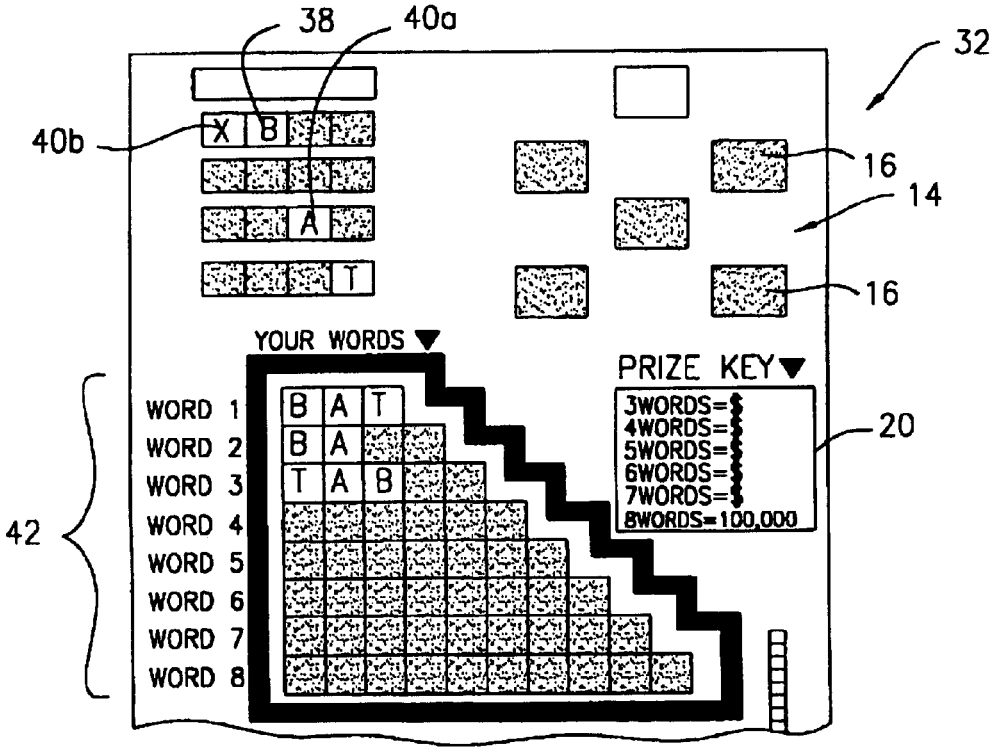

In a further embodiment of the present invention as shown in FIGS. 7 and 8, the second game area is provided with multiple groupings of key symbols (e.g. words) such that if a minimum number of multiple groups are obtained before all of the play areas in the third game area are exposed, then a prize may be won.

Referring to FIGS. 7 and 8 there is provided a lottery ticket 32 having a first game area 34 including a plurality of spaces 36 each of which has a target symbol 38 covered by a scratch-off layer 39. As in the other embodiments of the invention previously described the target symbols 38 include key symbols 40*a* but may also include non-key symbols 40*b*. A second game area 42 includes at least two (eight are shown in FIGS. 7 and 8) of multiple groups (i.e. word 1–word 8) in the form of rows of symbols such as words.

The play action game is applied by removing the scratch-off layer 39 from the first game area 34 to reveal individual key symbols 40*a* (the letters "B" "A" "T") and non-key symbols 40*b* (the letter "X" for example). The second game area 42 includes multiple groups (e.g. words) having the letters of each of the words exposed so that the player can determine which of the key symbols 40*a* uncovered in the first game area 34 find correspondence in the second game are 42. By way of example and referring specifically to FIG. 8, the player has thus far uncovered key symbols B, A, and T and one non-key symbol in the first game area 34. The player then identifies each space in the second game area 42 which contains the same key symbols. In addition, the player must remove the scratch-off layer 18 from one of the play areas 16 in the third game area 14 because the one non-key symbol 40*b* (i.e. the letter "X") has been uncovered.

The player continues until all of the spaces of the first game area have been exposed. The player fills in all of the key symbols in the second game area 42 to see how many words are formed while also revealing the non-key symbols in the third game area 14 each time a non-key symbol is exposed in the first game area 34. A prize is won if a minimum number of groupings of key symbols (e.g. words) are completed in the first game area as shown in the prize determining area 20.

Referring again specifically to FIG. 8, the player has uncovered four symbols (3 key symbols "B", "A", and "T" and one non-key symbol "X") from the first game area 34. As a result, word 1 has been completed and words 2 and 3 partially completed. If the player is able to complete at least two more words before exposing all of the non-key symbols and thereby completing the third game area, a prize will be won because the rules in this example require the completion of at least three words.

What is claimed is:

1. A scratch-off type lottery ticket comprising a substrate having thereon:

a) a first game area comprised of a plurality of target symbols comprising key symbols which are winning symbols and first non-key symbols which are non-winning symbols, said target symbols being covered by a removable opaque scratch-off layer wherein the number of target symbols is equal to the sum of the number of key symbols in the second game area and the number of second non-key symbols in the third game area;

b) a second game area comprised of at least some of said key symbols preprinted on the substrate; and c) a third game area comprised of a preselected number of play areas, each play area consisting of a second non-key symbol which are non-winning symbols, which may be the same or different than the first non-key symbols and covered by a removable scratch-off layer, said scratch-off layer being removed from an individual play area each time a first non-key symbol is exposed in the first game area by removing the scratch-off layer therefrom;

wherein the player exposes the target symbols from the first game area by removing the scratch-off layer and if the exposed target symbols provide all of the key symbols necessary to complete at least a predetermined portion of the second game area but not a number of first non-key symbols corresponding to the preselected number of play areas in the third game area, then a prize will be won.

2. The lottery ticket of claim 1 wherein the non-key symbols in the third game area are covered by an opaque scratch-off layer.

3. The lottery ticket of claim 1 wherein the first non-key symbols are the same as the second non-key symbols.

4. The lottery ticket of claim 1 wherein the first non-key symbols are different than the second non-key symbols.

5. The lottery ticket of the claim 1 wherein the second non-key symbols form part of the design of the third game area.

6. The lottery ticket of claim 1 wherein the second game area comprises key symbols arranged in a predetermined pattern.

7. The lottery ticket of claim 6 wherein the key symbols are letters arranged in the form of a word.

8. The lottery ticket of claim 1 wherein the key symbols are selected from the group consisting of letters, numbers, designs, pictures and objects.

9. The lottery ticket of claim 1 wherein the non-key symbols are selected from letters, numbers, designs, pictures, objects and blanks.

10. The lottery ticket of claim 1 wherein at least one of the second and third game areas comprises a dual transparent layer system comprising at least one clear, transparent scratch-off layer and at least one colored, transparent layer thereover made from a non-scratch-off material.

11. A scratch-off type lottery ticket comprising a substrate having thereon:

a) a first game area comprised of a plurality of target symbols comprising key symbols which are winning symbols and first non-key symbols which are non-winning symbols, said target symbols being covered by a removable opaque scratch-off layer;

b) a second game area comprised of multiple groupings of at least some of said key symbols preprinted on the substrate; and c) a third game area comprised of a preselected number of play areas, each play area consisting of a second non-key symbol which are non-winning symbols, which may be the same or different than the first non-key symbols and covered by a removable scratch-off layer, said scratch-off layer being removed from an individual play area each time a first non-key symbol is exposed in the first game area by removing the scratch-off layer therefrom;

wherein the player exposes the target symbols from the first game area by removing the scratch-off layer and if the exposed target symbols provide all of the key symbols necessary to complete at least a predetermined portion of the second game area but not a number of first non-key symbols corresponding to the preselected number of play areas in the third game area, then a prize will be won.

12. The lottery ticket of claim 11 wherein the multiple groupings of key symbols are words.

* * * * *